US007228779B2

(12) United States Patent
Van Dyke-Restifo et al.

(10) Patent No.: US 7,228,779 B2
(45) Date of Patent: Jun. 12, 2007

(54) AUTOMATIC PRIMER FEED MECHANISM

(75) Inventors: Stephen M. Van Dyke-Restifo, Voorheesville, NY (US); Lisa J. Madigan, Melrose, NY (US); Douglas F. Olcott, Saratoga Springs, NY (US); Dominick Scalise, Herkimer, NY (US)

(73) Assignee: United States of America as represented by the Secretary of the Army, Washington, DC (US)

( * ) Notice: Subject to any disclaimer, the term of this patent is extended or adjusted under 35 U.S.C. 154(b) by 395 days.

(21) Appl. No.: 10/501,620

(22) PCT Filed: Aug. 13, 2001

(86) PCT No.: PCT/US01/25605

§ 371 (c)(1),
(2), (4) Date: Jun. 8, 2004

(87) PCT Pub. No.: WO02/29350

PCT Pub. Date: Apr. 11, 2002

(65) Prior Publication Data

US 2005/0217469 A1 Oct. 6, 2005

Related U.S. Application Data

(60) Provisional application No. 60/230,450, filed on Sep. 6, 2000.

(51) Int. Cl.
*F41A 19/57* (2006.01)

(52) U.S. Cl. ..... 89/27.13

(58) Field of Classification Search ..... 89/137, 89/27.13

See application file for complete search history.

(56) References Cited

U.S. PATENT DOCUMENTS 1,095,558 A * 5/1914 Dawson et al. ..... 89/27.13
3,951,041 A * 4/1976 Bartolles ..... 89/27.13
5,331,880 A * 7/1994 Bartolles ..... 89/24

* cited by examiner

*Primary Examiner*—Stephen M. Johnson
(74) *Attorney, Agent, or Firm*—John F. Moran

(57) ABSTRACT

An automatic primer feed mechanism for use with a carrier assembly of a large caliber artillery piece, which includes mechanical assemblies for automatic primer loading after full breech closure and allows for spent primer cartridges to be extracted before opening of the breech to maximize safety, thereby allowing the gun crew to perform artillery piece misfire, sticker and check fire operations before the breech is opened. The mechanism includes a body member that mounts the automatic feed mechanism to the carrier of the artillery piece so as to interface with the carrier to position the mechanism on one side of the breech of the artillery piece. The body member includes a cam surface member, which provides a path for movement of an injection arm member. The tray member has guide rails for engagement with the body, which slides in relation thereto. A magazine containing a plurality of primer cartridges, which inserts in a receiver channel located in the tray member. The mechanism provides improved safety wherein live primers stored in a magazine are at a distance from the firing chamber hole that prevents flame from reaching a live charge before a fresh primer is injected therein.

9 Claims, 15 Drawing Sheets

AUTOMATIC PRIMER FEED MECHANISM

RELATED APPLICATIONS

This application claims benefit of filing date Nov. 15, 2000 based upon patent application of Stephen M. Van Dyke-Restifo, Ser. No. 09/718,106, now abandoned entitled "Automatic Primer Feed Mechanism", and also the filing date of Sep. 6, 2000 based upon provisional application of Stephen M. Van Dyke-Restifo et al., Ser. No. 60/230,450 and also entitled "Automatic Primer Feed Mechanism," which are hereby incorporated by reference.

STATEMENT OF GOVERNMENT INTEREST

The invention described herein may be manufactured and used by or for the United States Government for Governmental purposes without the payment of any royalties thereon.

BACKGROUND OF THE INVENTION

1. Field of the Invention

This invention relates generally to artillery systems and, more particularly to a system for automatically feeding primer cartridges in an artillery piece.

2. Description of the Prior Art

Present field artillery pieces operate by detonating a propellant charge behind a projectile in a gun barrel. Typically the propellant charge is detonated by means of a primer cartridge that, in turn, is detonated under the force of an externally applied blow or electrical current. A fresh (unfired) primer cartridge must be used for each firing of the artillery piece.

The technical advancement of heavy armored/mechanized weapons and the necessity of providing responsive, effective fires throughout the supported commander's area of influence has created a need for enhanced rate of fire and reduced labor intensiveness of the crew. Presently, for large caliber artillery pieces with interrupted screw block breech mechanisms such as 155-mm artillery pieces and the like, percussion primers are loaded by hand and various types of automatic feed mechanisms. One primer is typically manually placed in the spindle primer chamber and the firing mechanism is thereafter manually moved over the primer in the ready-to-fire position. This has lead naturally to human errors, injury and problems inserting the primer, especially when the light is dim. Lack of space and/or coordination are additional artillery piece problems associated with hand loading.

Until the present invention, there has not been effective fail-safe alternatives to manual loading of primers. There is need for a primer feed mechanism that automatically feeds live primers and ejects spent primer cases in large caliber artillery pieces (for example a 155-mm gun). Although one known automatic-type primer feed mechanism is taught in U.S. Statutory Invention Registration H-1121 by Carroll et al., which is hereby incorporated by reference, there are problems inherent with this mechanism that include potential accidental misfiring of a primer cartridge before proper closing of the breech, which in turn may result in accidental human casualty. Thus there is still need for a safe and efficient system for loading primer cartridges in the breech of a gun, which the present invention resolves.

OBJECTS AND SUMMARY OF THE INVENTION

In view of the foregoing, it is a general object of the present invention to provide a new and improved system for feeding primer cartridges in an artillery piece, which includes a means for automatic primer loading after full breech closure and spent primer extraction before breech opening to maximize safety, thus allowing the gun crew to perform gun misfire, sticker and check fire operations before the breech is opened.

It is a further object of the present invention to provide a new and improved system for feeding primer cartridges in an artillery piece, wherein the primer cartridges are automatically fed with minimum of handling by operating personnel, thereby saving time during a fire cycle.

It is a still further object of the present invention to provide a new and improved system for feeding primers in an artillery piece that is reliable and able to withstand the repeated recoil of the artillery piece as it is fired over and over. The automatic primer feed mechanism of the present invention offers several advantages. For example, loading is simplified because the gun crew need only handle previously loaded magazine assemblies rather than individual primers.

Yet another object of the present invention is to provide a device for automatically feeding primers, which reduces the number of required gun crew members.

Still another object of the present invention is to provide a device for automatically feeding primer cartridges to large artillery pieces and the like which is safe, dependable, and easy to maintain.

The above and other objects of the present invention are accomplished using the invention's automatic primer feed mechanism. In particular, the present invention provides a new and improved system for feeding primer cartridges in an artillery piece, which includes mechanisms for automatic primer loading after the artillery piece's breech is closed and spent primer extraction before the breech is opened again. This feature enhances gun crew safety and allows them to perform artillery piece misfire, sticker and check fire operations before the breech is opened.

The mechanism includes a body member for mounting the automatic primer feed mechanism to the carrier assembly of the artillery piece so as to position the mechanism on one side of the breech of the artillery piece. The body member also includes a cam surface member for control of motions of a primer injection arm member. The body member has guides that control movements of and retain a tray member. The tray member includes congruent guide rails for engagement with the body member's guides. A primer extraction member is attached to the body member for extracting spent primers when the tray member is moved to an extraction position of travel. The movement on the tray member is controlled by cooperative action with the injection arm member that is attached through linkages to an actuator attached to the carrier. The mechanism also includes a primer cartridge magazine mounted on the tray member for housing a plurality of primers for insertion into the artillery piece, including a slot in one side to permit the injector arm to cooperatively engage and move primers contained in the magazine upon movement of the injector arm to a ready-to-fire position. The tray member includes an integral receiver for mounting the magazine. Live primer cartridges are stored in the magazine that is attached to the tray. The tray member in turn is attached to the body member and located at a safe distance from the firing chamber within the spindle, thereby preventing flames from reaching a live charge before the primer is injected into the firing chamber. Such a design provides "hands-off" functionality during normal firing operation. The magazine uses a clip-type assembly for holding a plurality of primers. An open tray design allows ease of access to the firing chamber area for manual primer extraction if required.

During a fire cycle of operation, recoil motion of the artillery piece disconnects the primer feed mechanism from external actuator drive linkages wherein the tray member remains locked in a fire position during recoil and counter recoil. An external drive linkage of the primer feed mechanism re-engages the system mounted drive actuator on counter-recoil. The extract cycle of a spent primer cartridge is initiated after counter recoil and the extract cycle is completed prior to the breech of the artillery piece being opened. The primer feed mechanism can be manually, hydraulically, or otherwise power actuated from the fire position to the extract position of the mechanism. Spent primer extraction occurs when the tray member motion is at a location that actuates a pivoting extraction arm member that is retained in a cavity of the body member.

The operation of the device includes: a) opening the breech wherein breech opening locks the tray member in an extract position; b) load charge and projectile; c) close breech fully; d) inject a fresh primer cartridge wherein the injection arm member is manually, hydraulically or otherwise power actuated causing the tray member to translate from the extract to the fire position, and further causing the tray member's linear motion to dwell as the injector arm member rotates to inject a fresh primer, and further causing the linear motion of the tray to resume with the injector arm member in a down position, and further causing the mechanism's tray member to travel to the fire position, and the tray member is locked in a fire position; and e) the tray member is locked in the fire position ready to fire the artillery piece.

The mechanism provides improved safety wherein live primers stored in a magazine are at a distance from the firing chamber hole that prevents flame from reaching a live charge before a fresh primer is injected therein. A fresh primer is loaded after full breech closure and extracted before the breech is opened to maximize safety, and allowing a gun crew to perform misfire, sticker, and check fire operations before the breech is opened.

BRIEF DESCRIPTION OF THE DRAWING

For a more complete understanding of the invention, reference is hereby made to the drawings, wherein like numbers designate like parts, in which.

DETAILED DESCRIPTION OF THE PREFERRED EMBODIMENT

Figure 1:
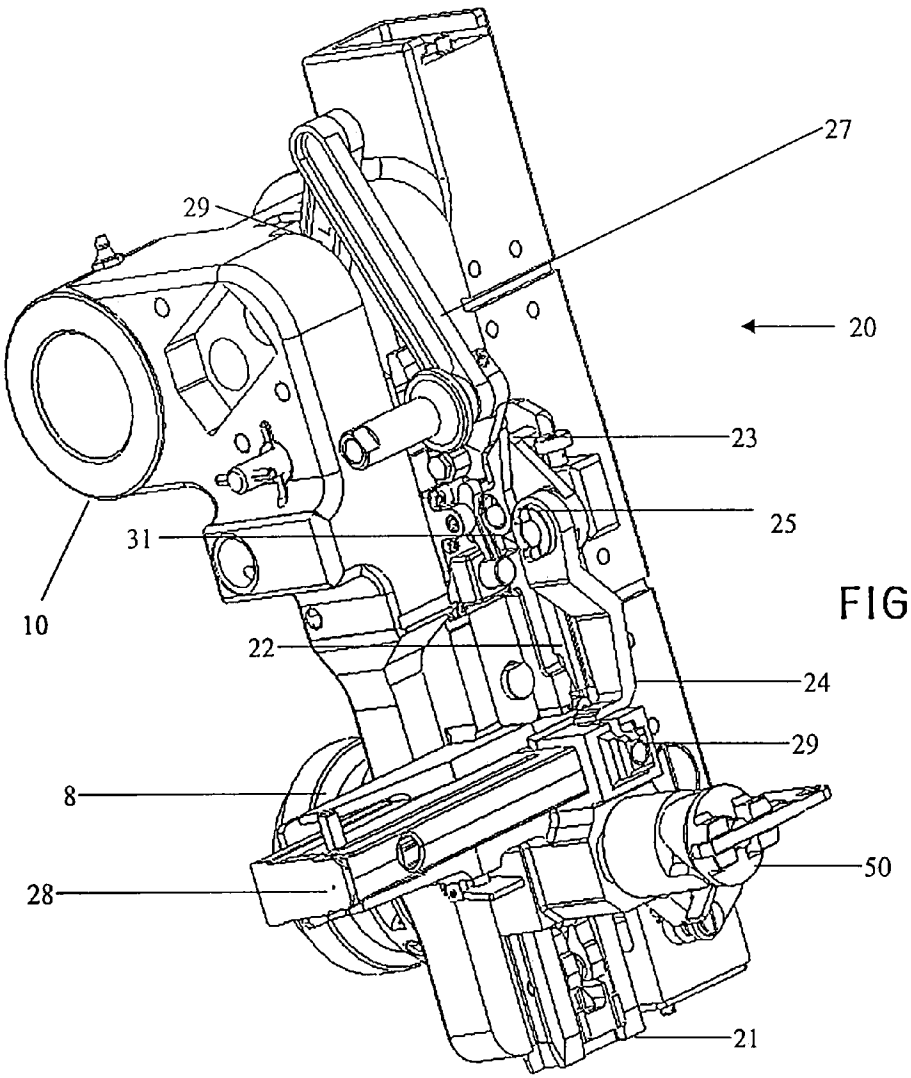
FIG. 1 is an isometric fragmentary perspective view of the mechanism when the primer is loaded for firing.

Referring to the drawings, and, in particular, to FIGS. 1–5, an automatic primer feed mechanism 20 embodying various features of the invention is shown in exemplary form mounted adjacent to the breech carrier end of an artillery piece. In accordance with conventional practice, the artillery piece includes a breech block (not shown for clarity) mounted to a hinged breech carrier 10 that swings to allow the breech to be opened and closed. The breech block's interior face includes an obturator that is carried at one end of a spindle extending through the breech block. The obturator and obturator spindle 8 include a central passageway 9 that terminates at one end in a chamber 4 for receiving therein a primer cartridge 26 of known construction. In use, a propellant charge is placed in the gun barrel ahead of the breech block which is then closed. Detonation of the primer cartridge 26 ignites the propellant charge through the passageway 9 to fire the artillery piece.

The automatic primer feed mechanism 20 functions broadly to contain a plurality of primers 26, to automatically and individually insert unfired primers into the chamber 4 and to automatically extract fired primers from the chamber in a safe manner so that the breech closes prior to insertion of the primer. To this end, the automatic primer feed mechanism 20 generally includes a clip-like magazine 28 for containing a plurality of primer cartridges 26, a mounting assembly formed in a tray 21 for mounting the magazine 28 to the feed mechanism 20, and a firing mechanism 50 retained in an opening 51, which is responsive to an operator input for firing the artillery piece. Preferably, the magazine 28 is a detachable unit so as to permit substitution of a magazine containing fresh primers.

Figure 2:
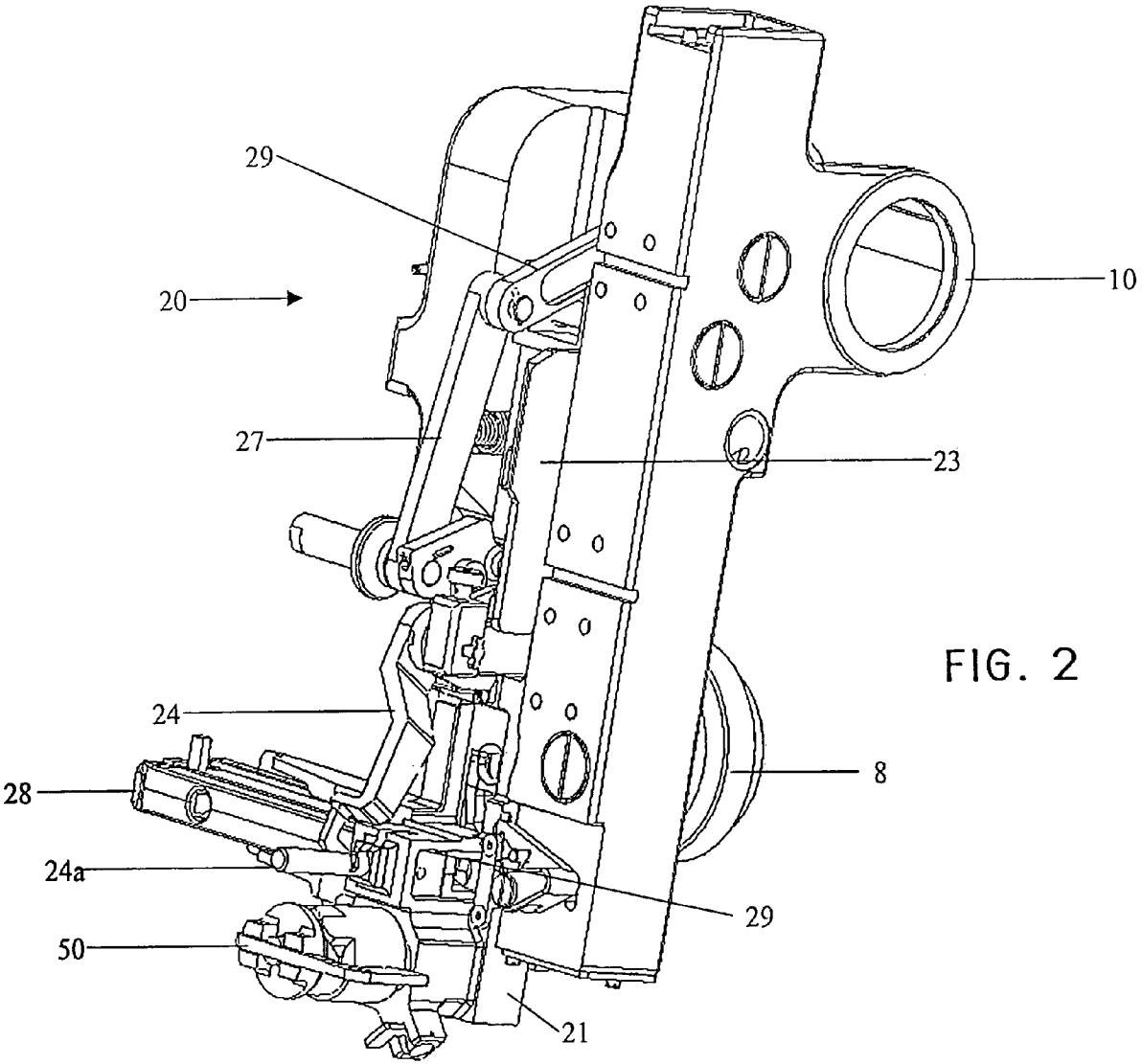
FIG. 2 is another isometric fragmentary perspective view of the mechanism at a different viewing angle with a primer being extracted.

Referring now to FIGS. 1 and 2, the primer feed mechanism 20 is designed for use with the carrier 10 of a large caliber artillery piece (in exemplary form, a 155-mm howitzer). A rack is inserted to the hinged carrier 10 that swings to allow opening and closing of the breech. The automatic primer feed mechanism assembly 20 includes a body member 23, a tray member 21, a cam surface channel member 22 that is part of the body member 23 wherein a pin 31 travels, and one or more linkage members 25, 27, 29 (in exemplary form) that cooperatively connect with an injection arm member 24, (the end linkage 29 connects with the carrier 10 which in turn has an actuator (not shown) attached to the carrier). One end of the injector arm member 24 travels in the cam surface member 22 by the actuator pin member 31 that is caused to move by the linkages 25, 27 and 29 by the carrier actuator. The other end of the injector arm 24 has an attached cylindrical member 24*a* that inserts through the member 29 forming part of the tray member 22 through a slot that in turn can be inserted into the magazine 28 when in a fire mode and act as a safety member. The cylindrical member 24*a* has a slot for accepting the arm member 24 such that the cylindrical member can rotate about pinned attachment member within the member 24*a* and allow translational injection movement of the primer into the firing chamber 4. Such a feature prevents jamming of the primer as it is injected and also minimizes misfiring of a primer cartridge during the injection operation. Also, the other end of the member 24*a* has a hollow surface so as to engage the primer cartridge outside of the central percussion area of the primer cartridge. In manual operation of the feed mechanism 20, the linkages 27 and 29 can be removed with ease by the gun crew and be manually operated. Moreover, the magazine 28 and the injection arm member 24 with the cylindrical injector 24*a* can be removed by a gun crew and the feed mechanism 20 can be operated by a handle attached to the tray member 23.

Figure 4:
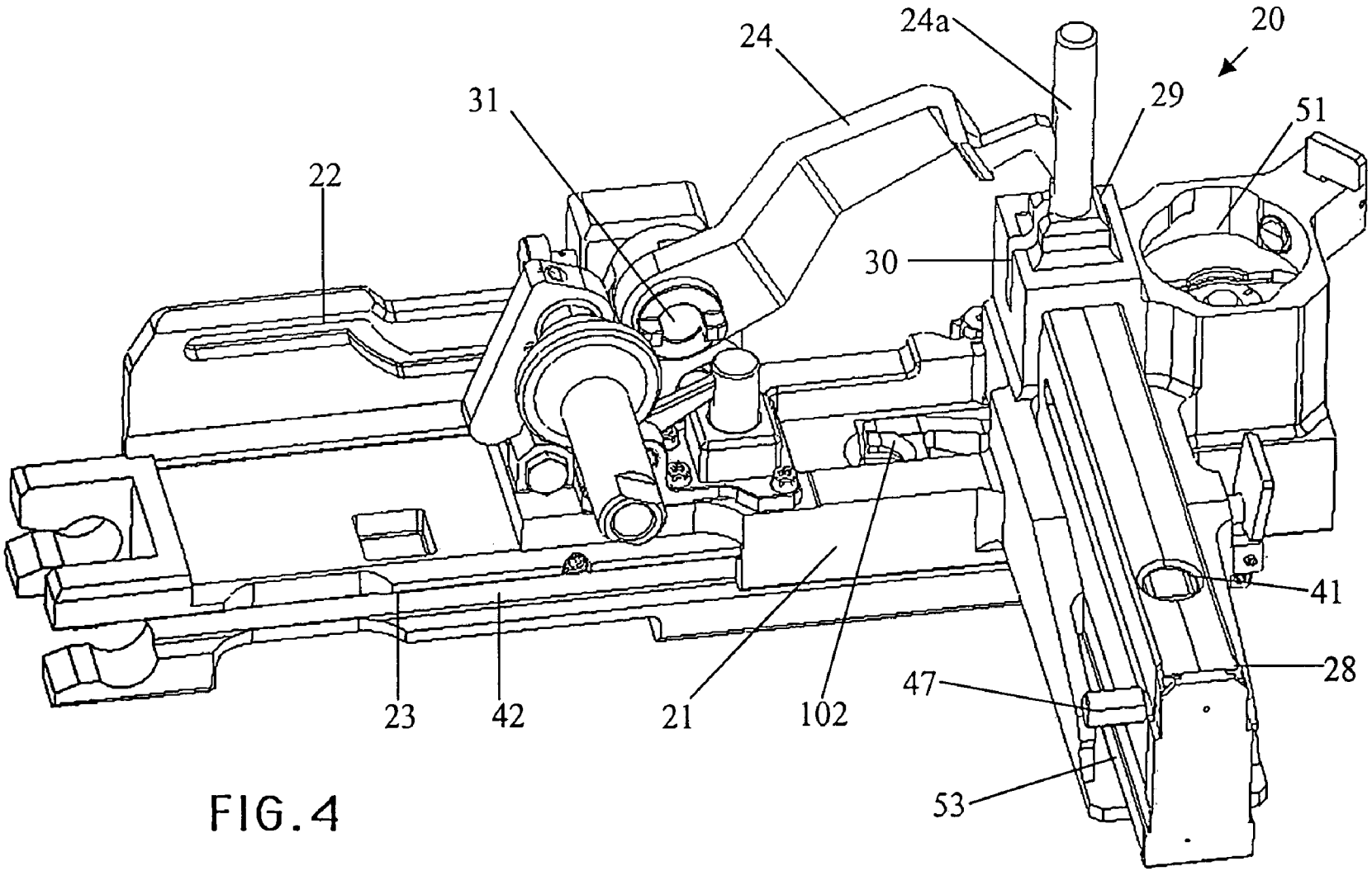
FIG. 4 is a view of an assembly of the components shown in FIG. 3.

The feed mechanism 20 is attached to the carrier 10 through the body member 23 and the tray member 21 slides on guide rail members attached to the body member. The body 23 is located on one side of the breech of an artillery piece. The body 23 includes a primer extractor member 102 (shown in FIG. 3*c*) that ejects spent primers during the eject cycle of operation of the primer feed mechanism. An assembled primer feed mechanism 20 as shown in FIG. 4 has the tray 21 slide into the body member 23 so as to control and constrain movement of the tray. The magazine assembly 28 also inserts and slides within a receiver in the tray.

Figure 3A:
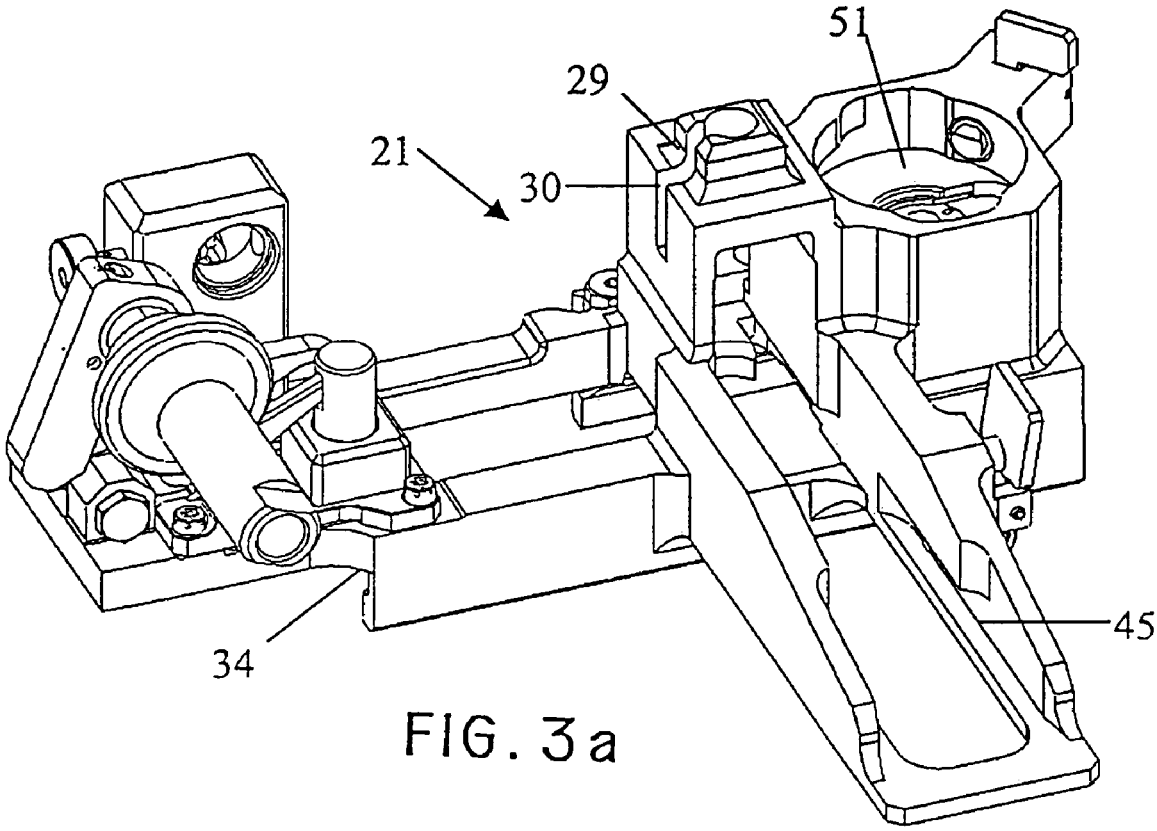
FIGS. 3*a*, 3*b*, 3*c*, 3*d* and 3*e* are views of a tray member, an injector arm member, a body member and a magazine assembly in both built up and broken out views respectively.
Figure 3B:
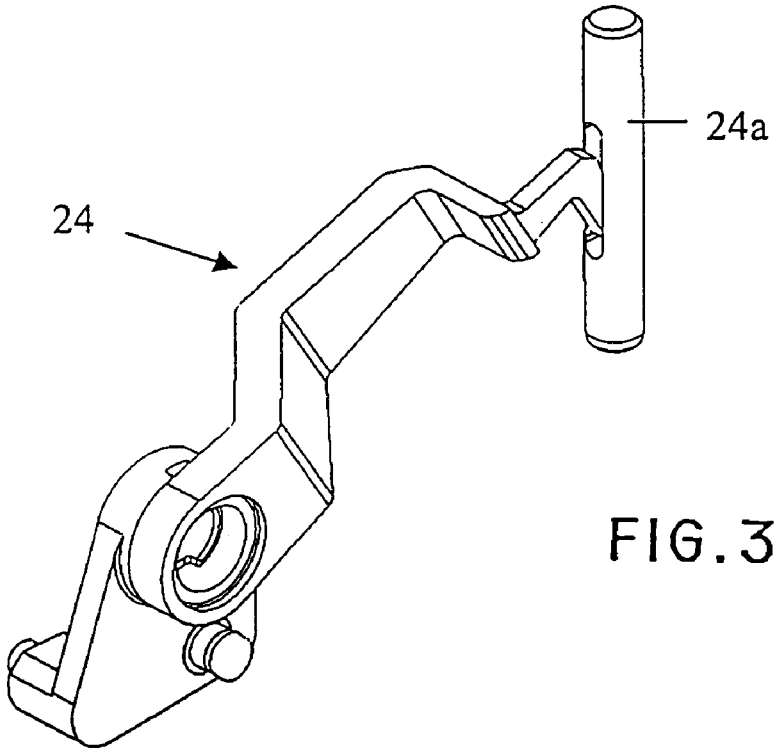
Figure 3C:
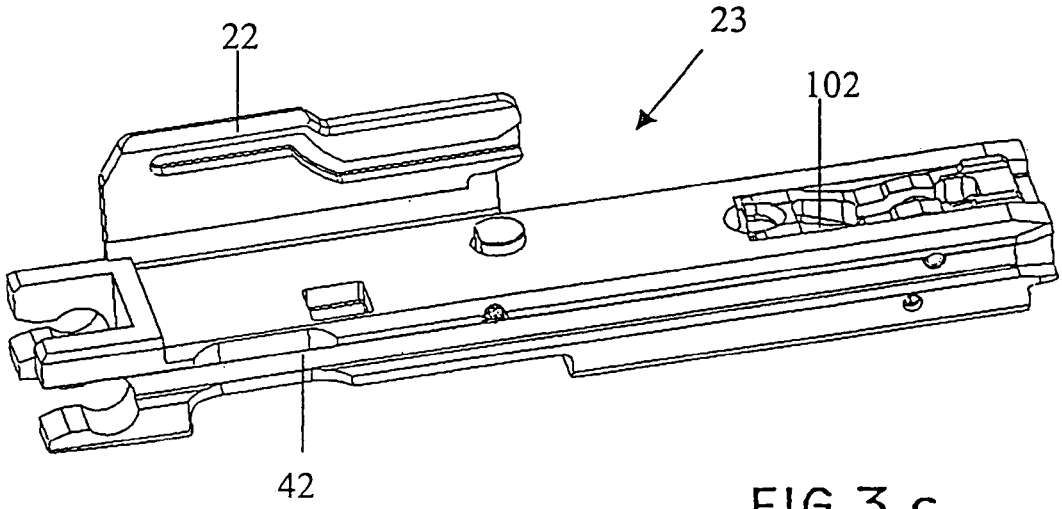
Figure 3D:
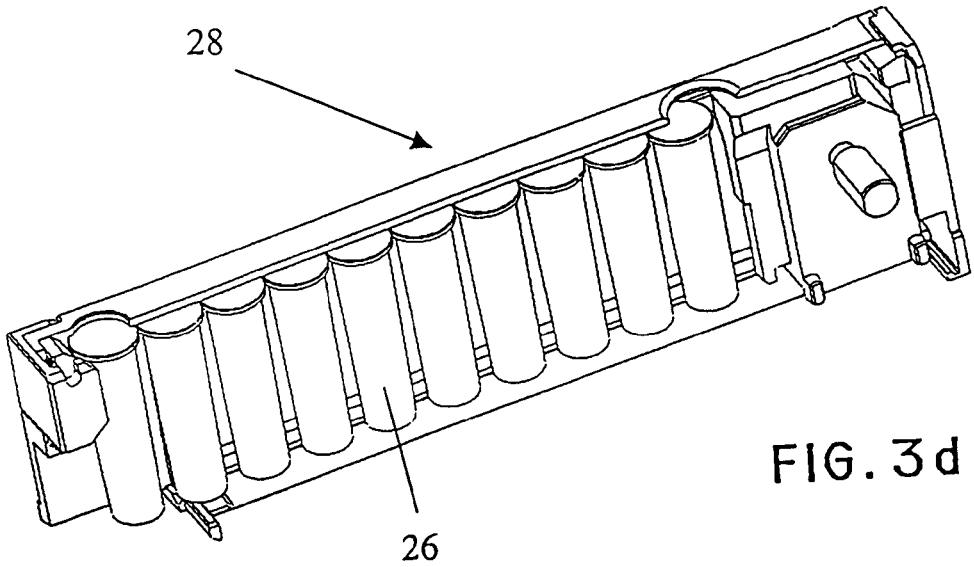

FIGS. 3*a*, 3*b*, 3*c*, 3*d* and 3*e* show views of a tray member, an injector arm member, a body member and a magazine assembly in both built up and broken out views respectively. The tray member 21, shown in detail in FIG. 3*a*, fits onto the body member 23 along the body way 34 shown in FIG. 3*a*. FIG. 3*b* shows the injection arm 24 with a cylindrical injection member 24*a* and the linkage with a dowel extended that follows the cam path surface of member 22. The body 23 has a cam channel member 22 that engages the injection arm 24, later described that moves the tray 21 through a pin linkage 31 that follows the cam path in the channel member 22. At the left end of the tray 21 is the firing mechanism 50 as shown in FIGS. 1 and 2, wherein a firing pin assembly is located under the firing mechanism. The firing mechanism 50 is typically a spring loaded mechanical firing mechanism that is detachable and inserted in the opening with a firing pin 51 in the tray member as shown in FIG. 3*a*.

Figure 3E:
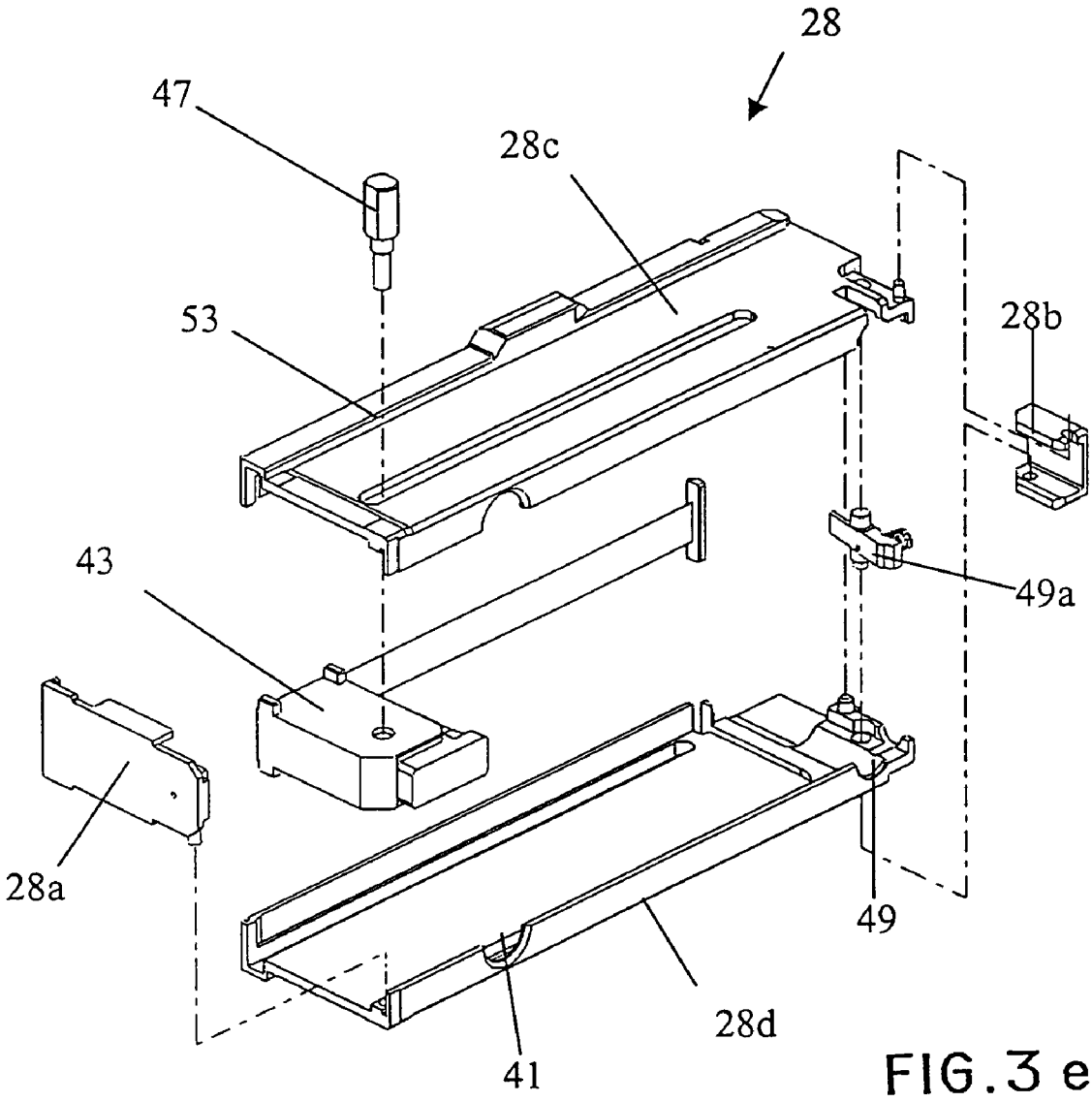

Construction of the magazine 28 can best be understood by reference to FIG. 3*e*. The magazine comprises a built-up clip retaining structure with end plates 28*a* and 28*b* with an opening 41 in one side for receiving individually the primers 26. A spring/plate 43 mounted in the base of the magazine structure properly biases and indexes the next available primer for firing. A coiled flat constant tension spring is retained in the plate structure and a terminal end attaches to one end of the magazine 28. A guide member 49*a* provides proper alignment of a fresh primer during injection. A hand operable pin 47 interfaces with a slot in the side plate of the mechanism for manual operation and proper alignment of the plate 43. Opening 49 interfaces with the injection arm cylindrical member 24*a* under tray member housing structure 29. A pair of retention guides 53 along the sides of the magazine provide proper alignment and retention in the receiver portion of the tray 21 when attached to the mechanism 20. In preferred form, up to ten primers 26 can be stored in the magazine 28.

Figure 3F:
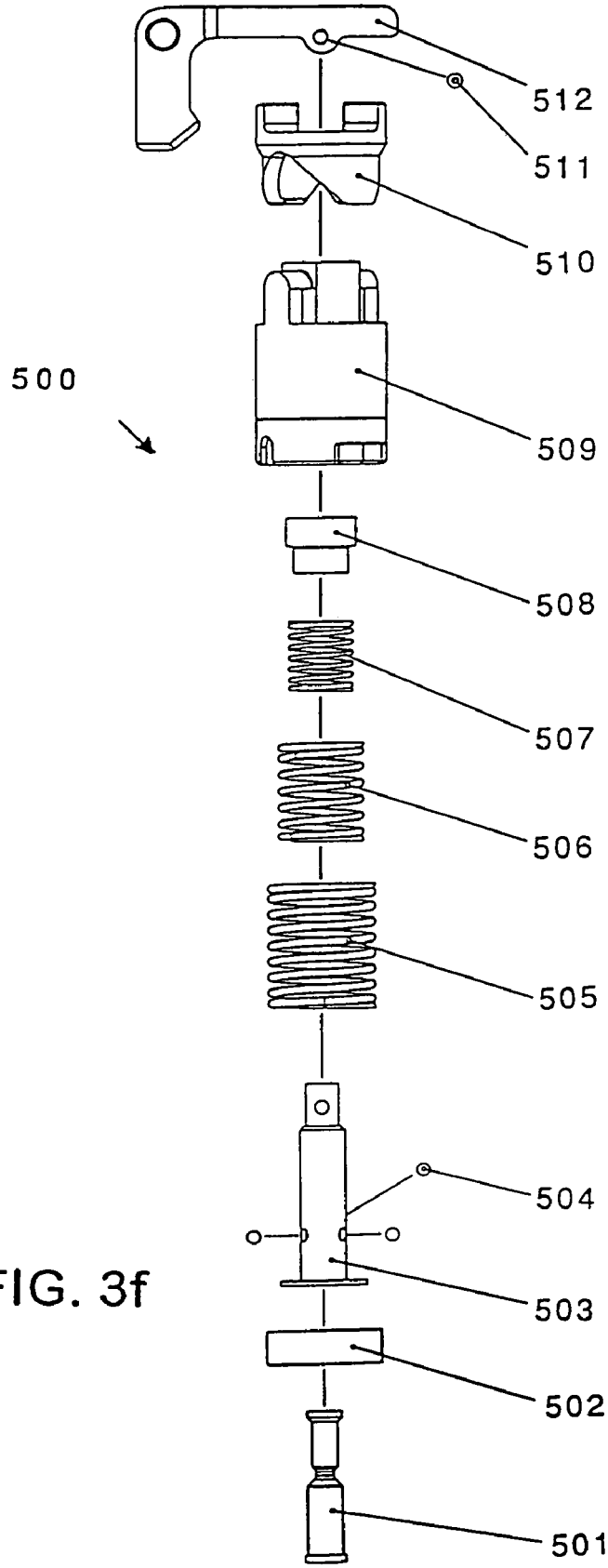
FIG. 3*f* shows an assembly view of a primer firing mechanism used with the present invention.

The invention can use various types of a firing mechanism 50 that include a solenoid-type firing mechanism or a mechanical-type firing mechanism. The preferred firing mechanism is shown in FIG. 3*f* that shows an assembly view of a mechanical firing mechanism 500. This mechanism provides improved reliability since the dual cam surfaces of the upper portion of a case assembly mates with a follower member has greater interfacing surface areas, thus minimizing both jamming of the firing mechanism and misfiring. The firing mechanism 500 includes: a hammer member 501, a cup member 502, a yoke 503, multiple ball bearings 504, multiple helical compression springs 505, 506 and 507, a sleeve member 508, a case assembly 509 with a special dual cam surface that cooperatively interfaces with a dual cam follower member 510, a pin member 511, and a pull lever 512. When assembled, the mechanism 500 is held together under compression by the pin 511 through a hole in the lever 512. The hammer member 501 is held in place within the yoke 503 by the ball bearings 504.

In operation, the mechanism 500 is actuated and ready to fire an artillery piece by pulling or twisting the lever 512 which causes either direct pulling of the lever member and pulling back on the hammer or cause the interfacing dual cam surfaces of the case assembly 509 and the follower 510 to rotate such that the follower 510 is distended outwards from the case assembly 509. Once the lever 512 is released, the follower snaps back towards the case assembly 509 which in turn releases the yoke 503 containing the hammer piece 501, with consequential detonation of a fresh primer cartridge in the firing chamber.

OPERATION OF THE INVENTION: Operation of the primer feed mechanism 20 can best be understood by reference to FIGS. 5–12. The operational phases of the mechanism include: a) firing of the artillery piece, b) recoil/counter-recoil of the artillery piece, c) ejection of the spent primer cartridge, d) opening the breech, e) loading ammunition into the artillery piece, f) close the breech, g) load a fresh primer into the firing chamber of the breech, and h) ready to fire the artillery piece again. As illustrated, the operation of the mechanism 20 can be referred to as a primer load cycle and a primer eject cycle wherein the breach is closed in FIGS. 5, 6, 7 and 10, 11 and 12. The breech is opened in FIG. 8, and subsequently closed in FIG. 9 after loading ammunition. The arrows in FIGS. 5–12 adjacent to the linkages and arms 24, 25, 27 indicate operational dynamics of the mechanism.

Figure 5:
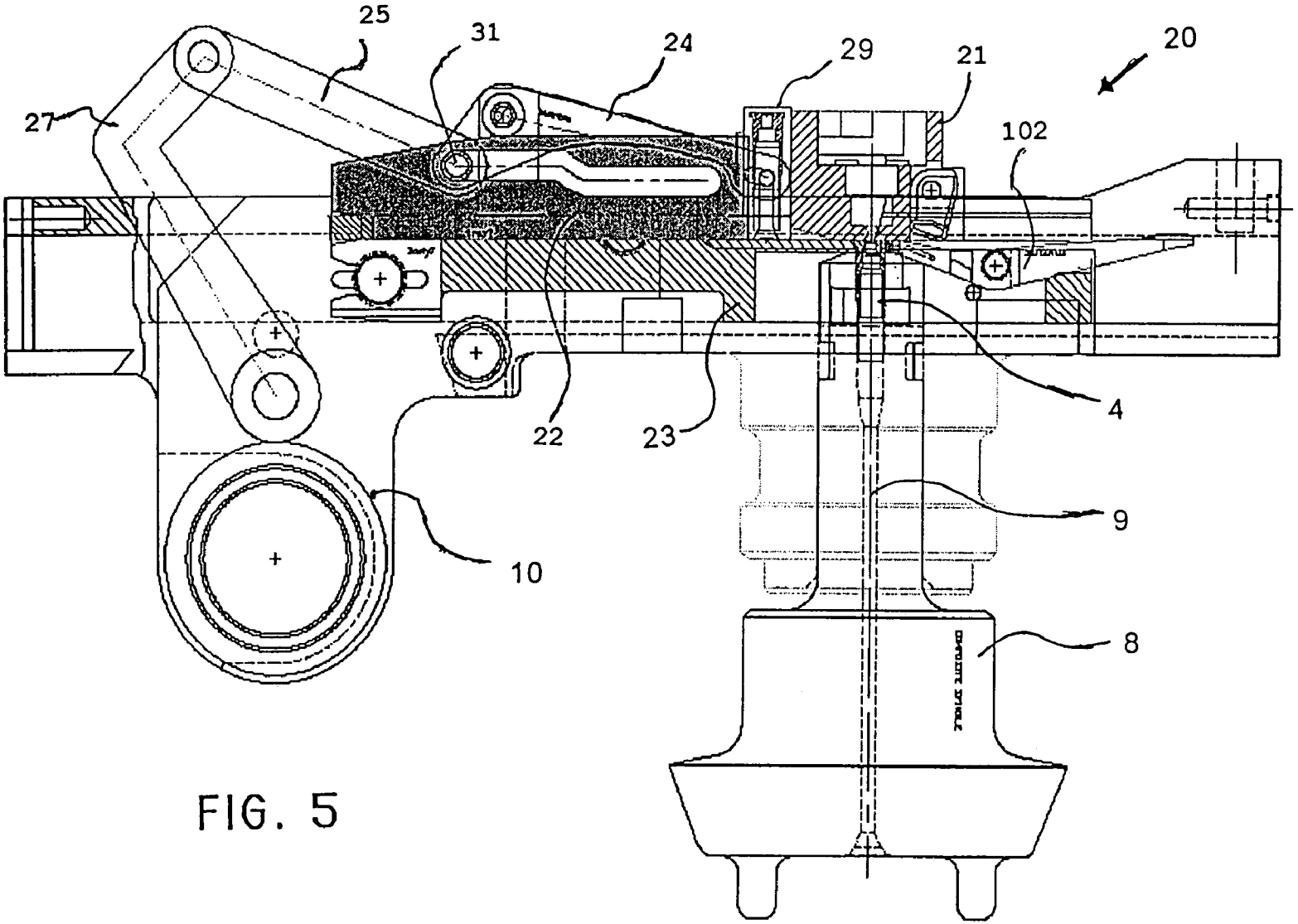
FIG. 5 is a side view of the mechanism in a ready to fire position and starting point of the extraction cycle.

In FIG. 5, an initial condition is firing of the artillery piece wherein the breech is closed and fresh ammunition is in the artillery piece, fresh primer is in the firing chamber, the tray member 21 is locked to the body member 23 with a tray/body lock. The tray is locked with the firing mechanism 50 over the firing chamber 4 with the fresh primer within. The injector arm 24 is down and inside the magazine 28. The artillery piece system mounted power actuator is engaged with the feed mechanism 20 externally mounted actuator drive, which is mounted to the carrier that transmits motion to the injector linkages and ultimately the injection arm 24 through a cross-shaft in the carrier. The artillery piece is fired by actuation of the firing mechanism 50 causing the primer to detonate and igniting the main propellant charge and then causing the ammunition to fire. After firing, recoil motion of the artillery piece disengages the system mounted powered actuator from external actuator drive to the mechanism 20. The tray member 21 remains locked to the body member 23 through the tray/body lock. Then on counter-recoil of the artillery piece, the system actuator engages the external drive linkages to the feed mechanism 20 and the tray member 21 remains locked to the body member 23 through the tray/body locked.

Figure 6:
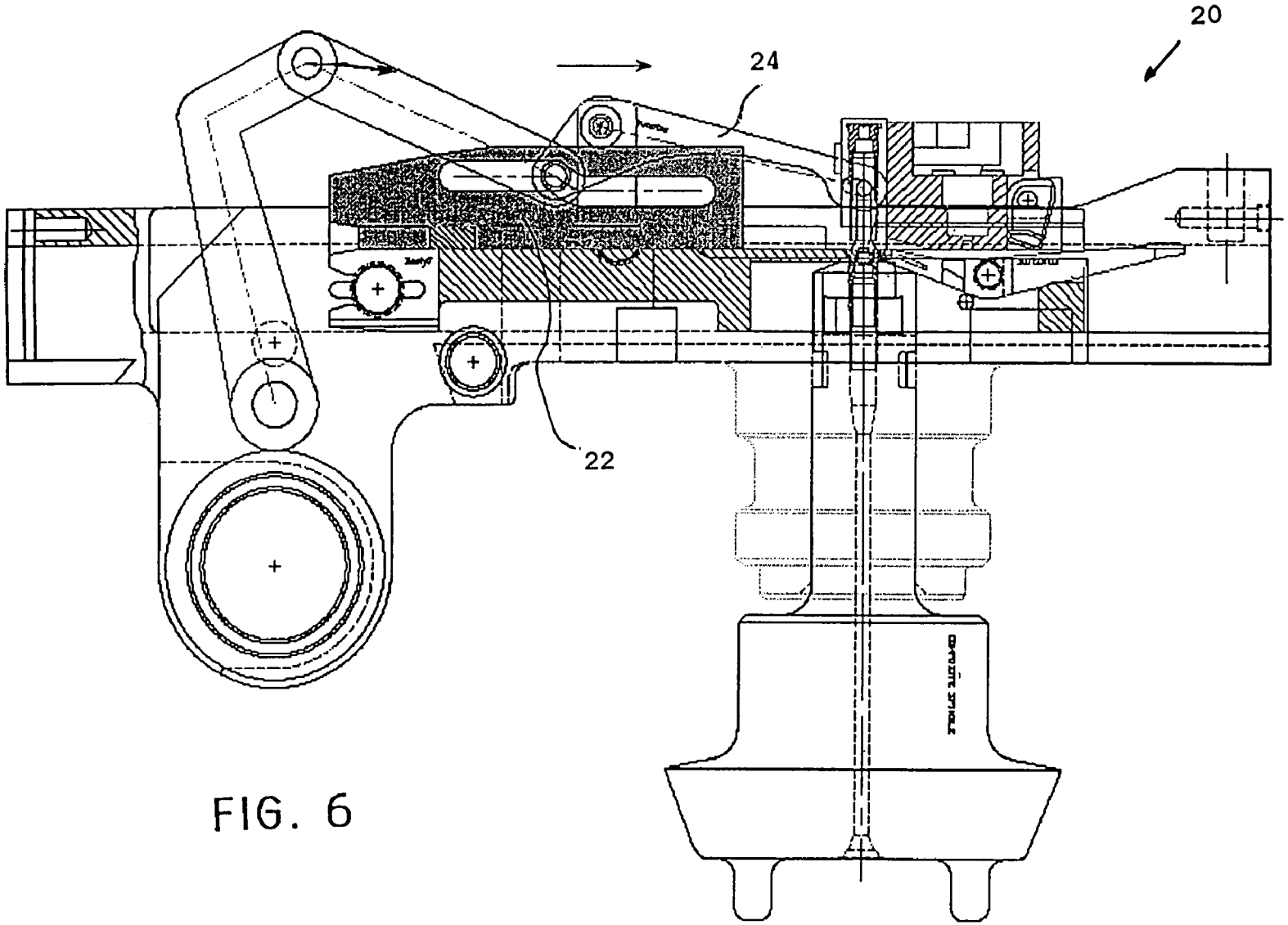
FIG. 6 is a side view of the primer extraction cycle of the mechanism, breech closed phase.

Next, initiation of the primer eject cycle as shown in FIG. 6 begins wherein the breech is still closed. The system mounted actuator applies load to the feed mechanism 20 through the linkages 25 and 27 through the pin 31 that connects to injection arm 24 to unlock the tray/body lock member and allow the tray 21 to move. Continued application of load to the injector arm 24 communicates linear motion to the tray member through the cam surface member 22.

Figure 7:
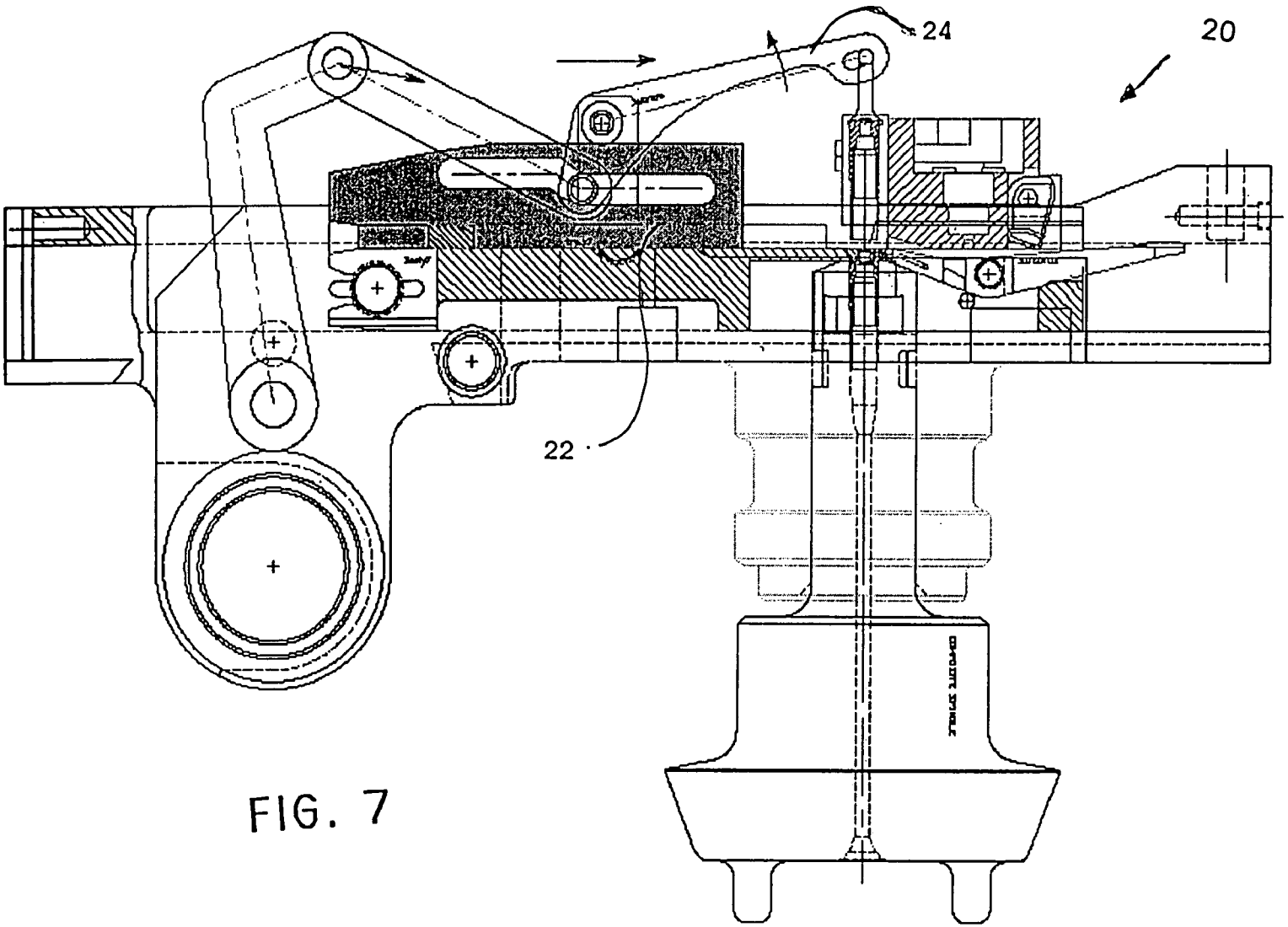
FIG. 7 is a side view of the primer extract cycle phase of the mechanism in a raise injector arm, continue extration cycle, breech closed.

Next, as shown in FIG. 7, with the breech still closed, the primer eject cycle of the mechanism continues where continued loading of the injector arm 24 occurs causing it to rotate and rise out of the magazine 28 while linear translation of the tray member 21 dwells. The next fresh primer is indexed in the magazine. Continued loading of the injection arm 24 causes the tray to then resume linear translation towards a full extract position of travel within the body member 23.

Figure 8:
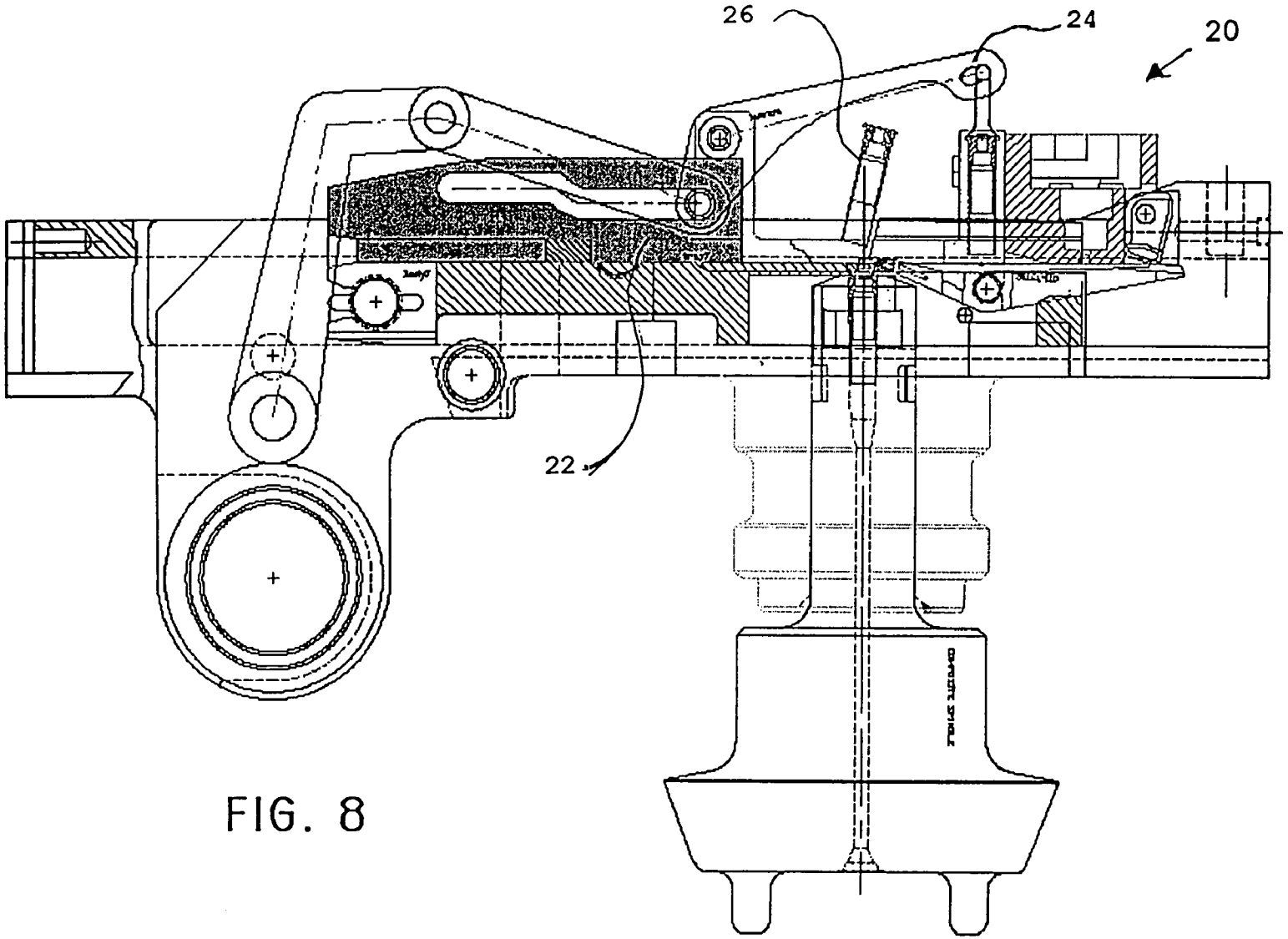
FIG. 8 is an side view of the primer extraction cycle phase of the mechanism in an extract fired primer position followed by an open breech phase.
Figure 9:
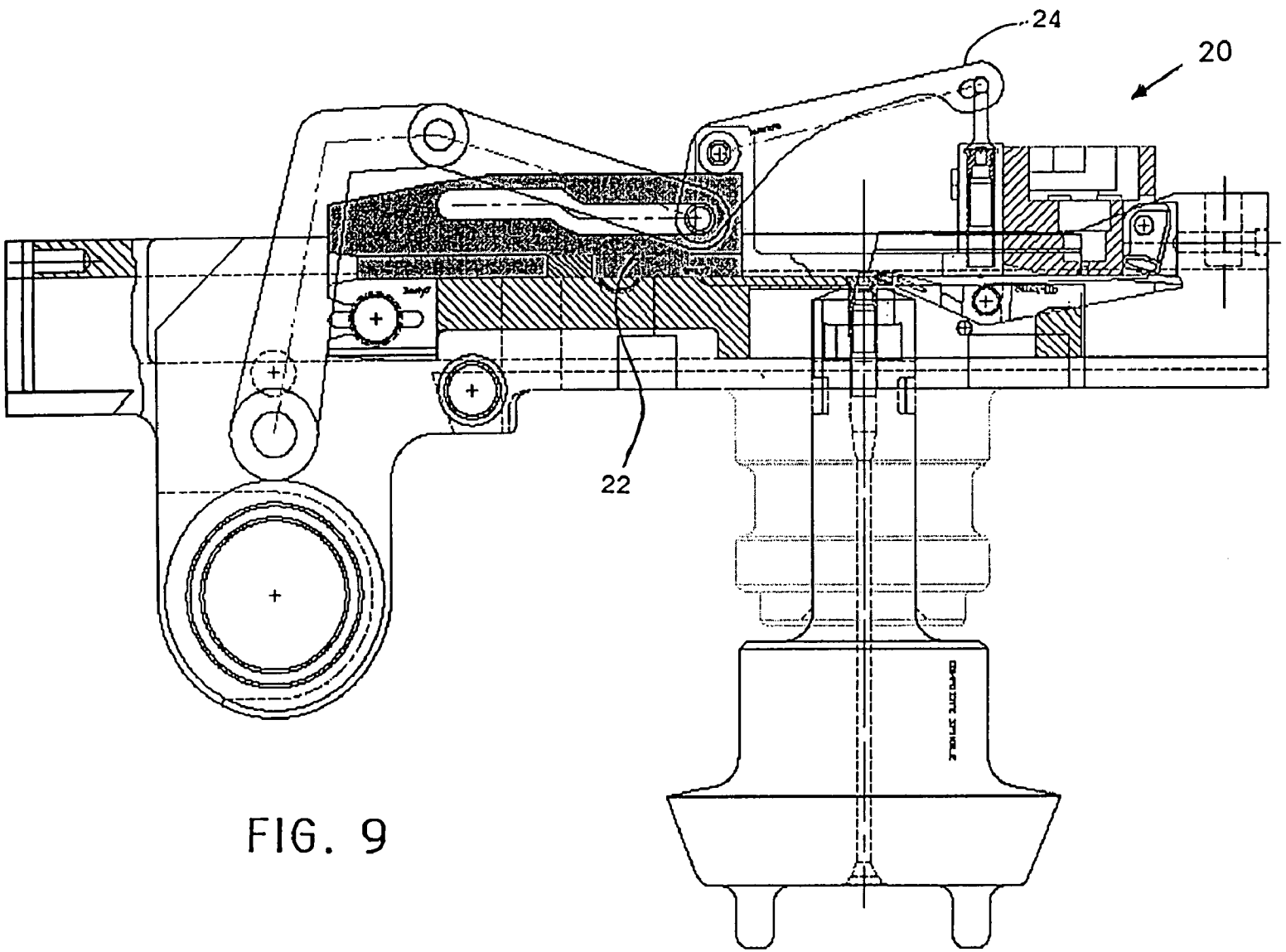
FIG. 9 is a side view of the initiation of the primer load/inject cycle phase of the mechanism, breech closed.

In FIG. 8, the spent primer is extracted as the tray member 21 actuates the extractor arm member 102 in the body member 23 during terminal travel of the tray by rotating the member 102. The tray member is then in a full extract position. The breech can then be opened and fresh ammunition can be loaded into the artillery piece. Opening of the breech engages a carrier mounted safety latch that latches the tray 21 in a full extract position as shown in FIG. 9. In this condition, the tray and the feed mechanism 20 cannot be accidentally moved to load a fresh primer when the breech is open. A fresh projectile and propellant charge can then be loaded into the artillery piece and the breech closed. After complete closure of the breech, the carrier mounted safety latch is then released and the primer injection cycle begins where the load can again be applied to the injection arm 24.

Figure 10:
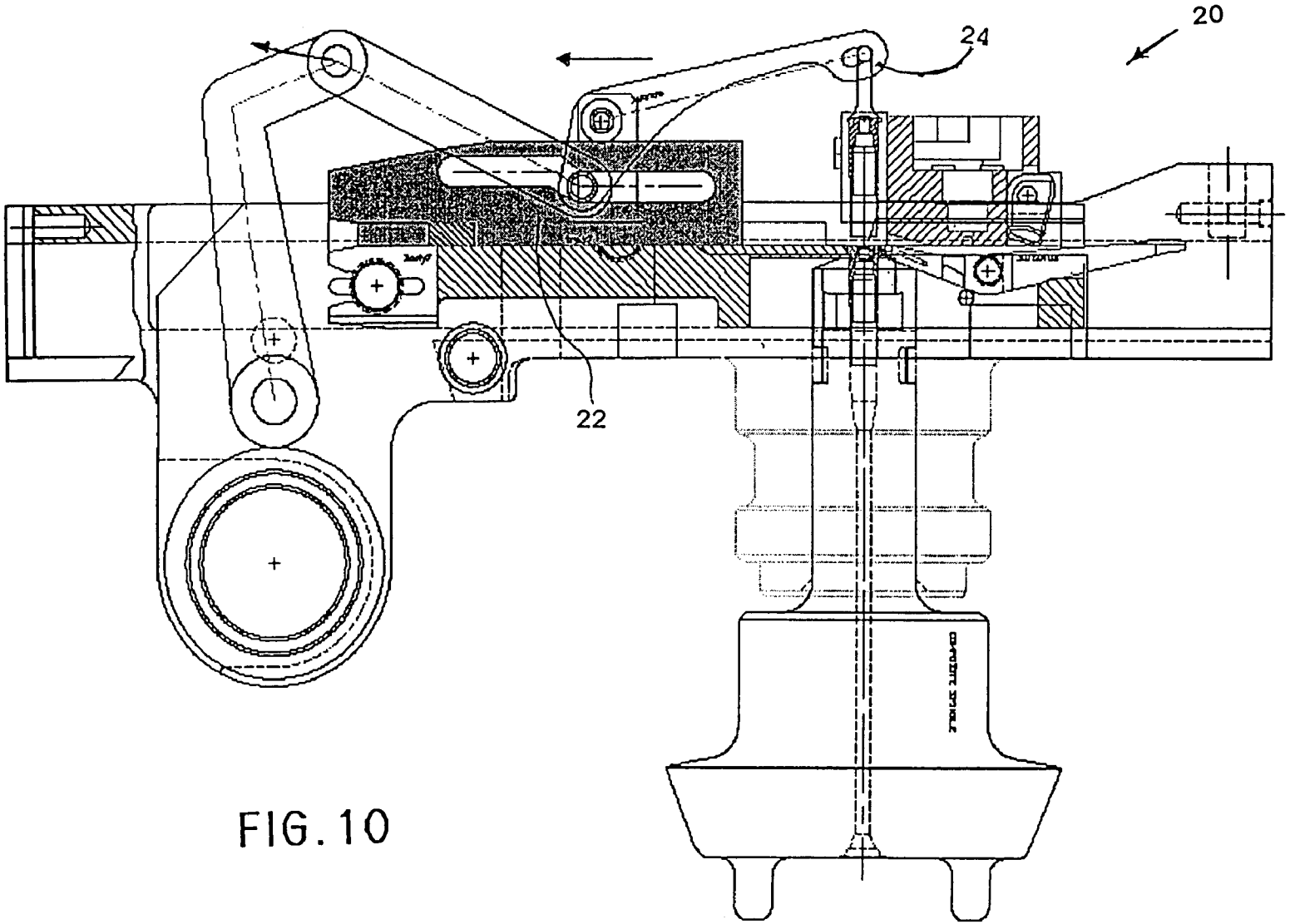
FIG. 10 is a side view of the primer load inject cycle phase of the mechanism in an initiate injection cycle, breech closed phase.

In FIG. 10, the primer loading cycle shows a fresh primer, indexed to be in-line with the injection port 49 of the magazine 28, wherein the tray 21 dwells as the injection arm 24 rotates by the interactions of cam surface member 22 causing injection of a fresh primer into the firing chamber 4 as the tray motion dwells.

Figure 11:
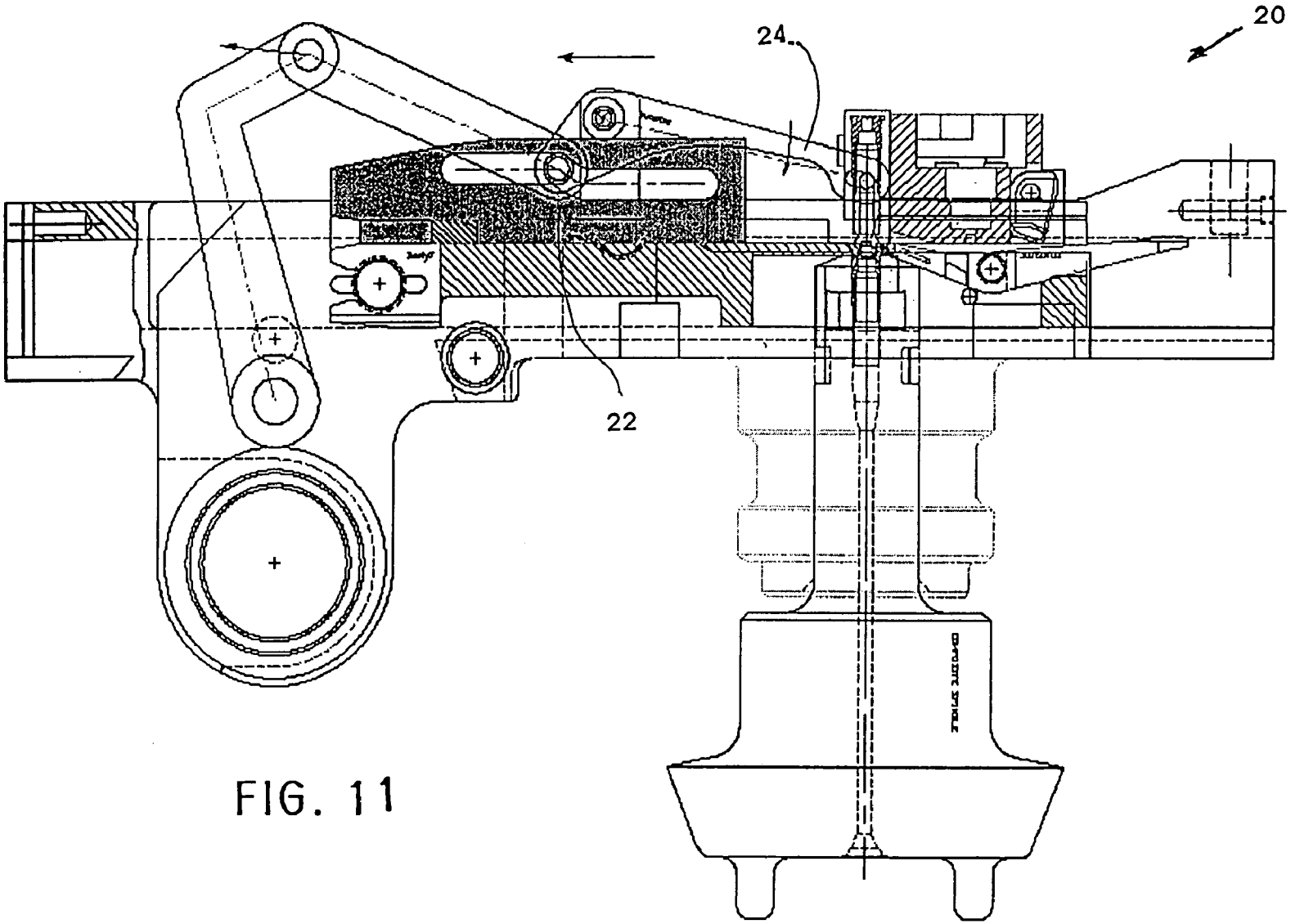
FIG. 11 is a side view of the primer injection load cycle phase of the mechanism in a primer injected cycle where the injector arm rotates to inject the primer, breech closed.

In FIG. 11, the linear motion of the tray member 21 resumes with the injector arm 24 and member 24*a* injecting the primer into the firing chamber by downward translational motion of the injection member 24*a* within the tray housing 29 until the primer is loaded into the firing chamber.

Figure 12:
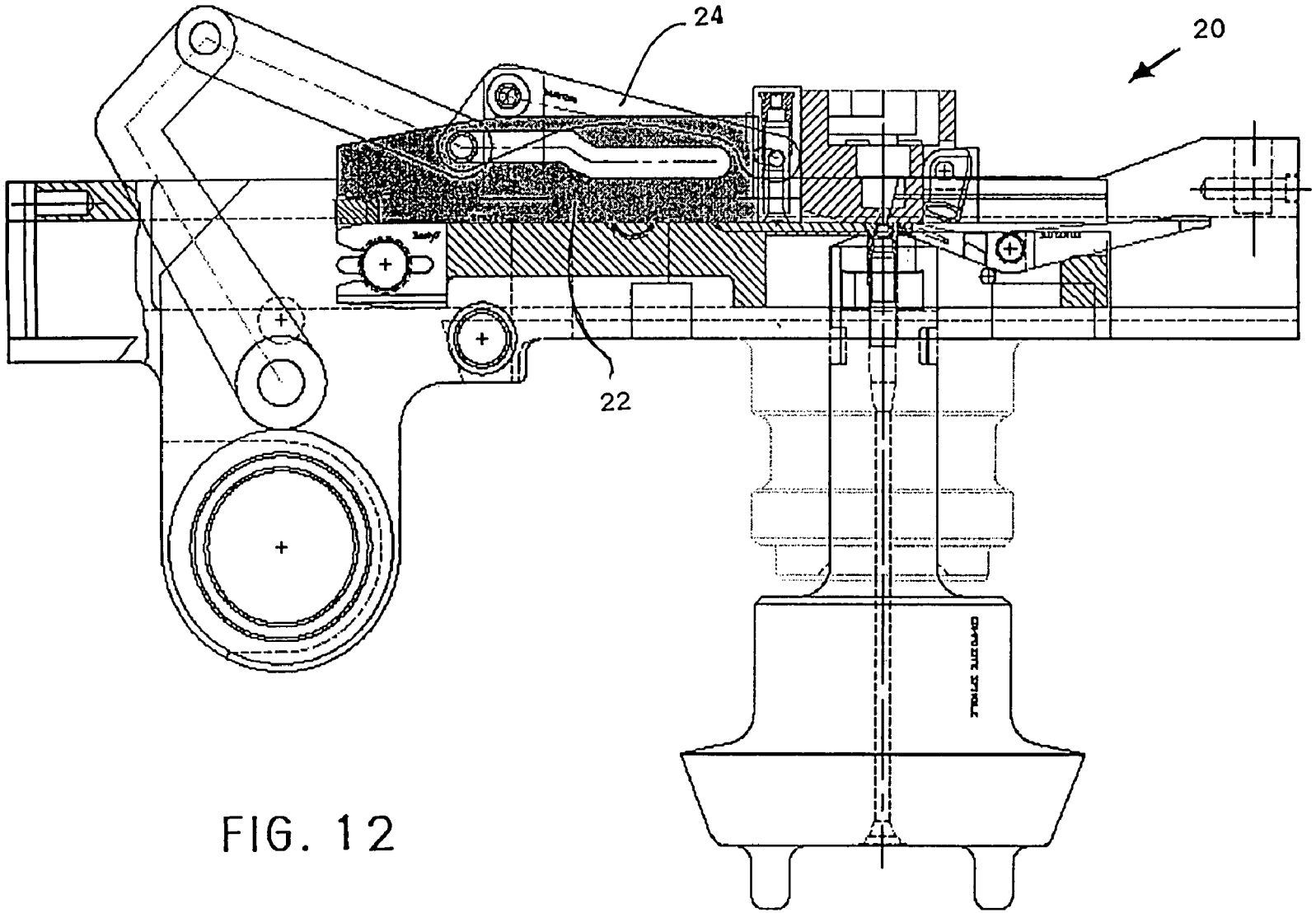
FIG. 12 is a side view of the primer fire cycle phase of the mechanism, primer loaded and in a fire position.

In FIG. 12, the tray translational motion continues to the end of travel and the firing mechanism 50 is positioned over the fresh primer. The injection member 24*a* is positioned in the magazine through the opening 49. Termination of tray motion causes the tray/body lock to re-engage, locking the tray 21 to the body member 23 in a fire position. The primer feed mechanism 20 is in firing position again as in FIG. 5 and the artillery piece is ready to fire again.

While particular embodiments of the present invention have been illustrated and described herein, it is not intended that these illustrations and descriptions limit the invention. Changes and modifications may be made herein without departing from the scope and spirit of the following claims. For example, the primer feed mechanism can be readily adapted for use with a variety of existing artillery pieces. Moreover, the invention can be used in non-military application where a machine requires an automatic injection mechanism that allows injection of a cartridge into a chamber during operation of the machine and precludes need for opening of an object attached to the injection chamber, thereby affording continuous safe operations of the machine. Therefore to be understood, that within the scope of the appended claims, the invention may be practiced otherwise than as specifically described.

What is claimed is:

1. A primer feed mechanism mounted on a carrier for an artillery piece having a breech end, the mechanism comprising:

a body member for mounting the mechanism to the carrier, including means for a) interfacing with the carrier to position the mechanism on one side of the breech end of the artillery piece, b) providing constrained movement of a movable tray member;

the tray member including rails for engagement on the body member and also providing for a housing with a channel in which a primer injector arm member moves;

one end of the primer injector arm member including means for engaging a cam surface channel member that is attached to the body member, the means for engaging includes a linkage member that follows a cam path in the cam surface channel member, an other end of the arm member has a cylindrical member that is pivotally attached, whereby rotary motion of the arm member causes linear injection of a primer cartridge into a firing chamber; and an extraction member attached to the body member, the extraction member allowing displacement of a spent primer cartridge out of a firing chamber.

2. The mechanism of claim 1, wherein the mechanism is a primer feed mechanism and further includes a magazine mounted on the tray member for housing a plurality of primers.

3. The mechanism of claim 2, wherein the tray member includes an integral receiver for mounting the magazine.

4. The mechanism of claim 3, wherein the magazine includes guide members on sides of the magazine for sliding into the receiver of the tray, the primer injector arm member with the cylindrical member pivotally attached thereto cooperatively engages and moves a fresh primer contained in the magazine upon movement of the tray member to a ready-to-fire position, the magazine includes a constant tension spring member housed in an plate structure to provide indexing of the plurality of primers.

5. The mechanism of claim 1, wherein the extraction member comprises a spring biased lever member that pivots from within a cavity in the body member and is actuated by displacement of the tray member in relation to the body member.

6. The mechanism of claim 1 further comprising a firing mechanism disposed in a recessed portion of the tray member.

7. The mechanism of claim 6, wherein the firing mechanism comprises a solenoid actuated firing mechanism.

8. The mechanism of claim 6, wherein the firing mechanism comprises a mechanical actuated firing mechanism.

9. The mechanism of claim 8, wherein the mechanical firing mechanism comprises an in-line hammer member, a cup member, a yoke member, multiple ball bearings, at least one helical compression spring, a sleeve member, a case assembly with a special dual cam surface that cooperatively interfaces with a dual cam follower member, a pin member, and a pull lever, whereby the firing mechanism can be actuated by both direct and rotational pulling of the lever.

* * * * *